US005868151A

United States Patent [19]

Kuo

[11] Patent Number: 5,868,151

[45] Date of Patent: Feb. 9, 1999

[54] CONTROLLING APPARATUS OF AN UMBRELLA

[76] Inventor: Cheng Miao Ling Kuo, 8F, No. 39, Sau Nen Street, Hsinchu, Taiwan

[21] Appl. No.: 53,724

[22] Filed: Apr. 2, 1998

[51] Int. Cl.[6] ..... A45B 25/14

[52] U.S. Cl. ..... 135/24; 135/22; 135/28

[58] Field of Search ..... 135/22, 24, 28, 135/25.4, 25.41, 37, 38, 39, 40, 41

[56] References Cited

U.S. PATENT DOCUMENTS

| | | | |
|---|---|---|---|
| 5,178,174 | 1/1993 | Wu | 135/22 |
| 5,267,583 | 12/1993 | Wu | 135/24 |
| 5,492,140 | 2/1996 | Lin et al. | 135/24 |
| 5,505,222 | 4/1996 | Lin et al. | 135/24 |
| 5,566,698 | 10/1996 | Yu | 135/24 |
| 5,588,454 | 12/1996 | Kou | 135/22 X |
| 5,617,889 | 4/1997 | Wu | 135/25.3 X |
| 5,626,160 | 5/1997 | Ko | 135/22 |
| 5,632,290 | 5/1997 | Kuo | 135/28 X |
| 5,645,094 | 7/1997 | Wu | 135/24 |

*Primary Examiner*—Lanna Mai
*Attorney, Agent, or Firm*—Rosenberg, Klein & Bilker

[57] ABSTRACT

This invention relates to an improved controlling apparatus of an umbrella which includes an opening slice, a closing slice, and an L-shape slice in a handle of the umbrella. A button on the handle can be pressed to control the opening slice or the closing slice moved inward to open or close the umbrella. Since the L-shape slice will be pushed downward before the button is pressed to open the umbrella, it is possible to prevent from any mistake when in opening operation of the umbrella.

3 Claims, 6 Drawing Sheets

CONTROLLING APPARATUS OF AN UMBRELLA

BACKGROUND OF THE INVENTION

An umbrella, which is capable of being opened or closed automatically has been widely used. One of the known umbrellas includes two buttons to control an opening means and a closing means in a handle of the umbrella for operating the umbrella to be opened or to be closed automatically. Different control apparatus has different effect when being used. It is known that most prior umbrellas are usually with a possibility in missing contact with the closing button when a user is going to open the umbrella. Under this mistake, the control apparatus would be damaged and broken and the umbrella can not be used anymore.

OBJECT OF THE INVENTION

The main object of the present invention is to provide an improved control apparatus of an umbrella, which can control the opening or closing of the umbrella without any possibility for any user to operate in mistake.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
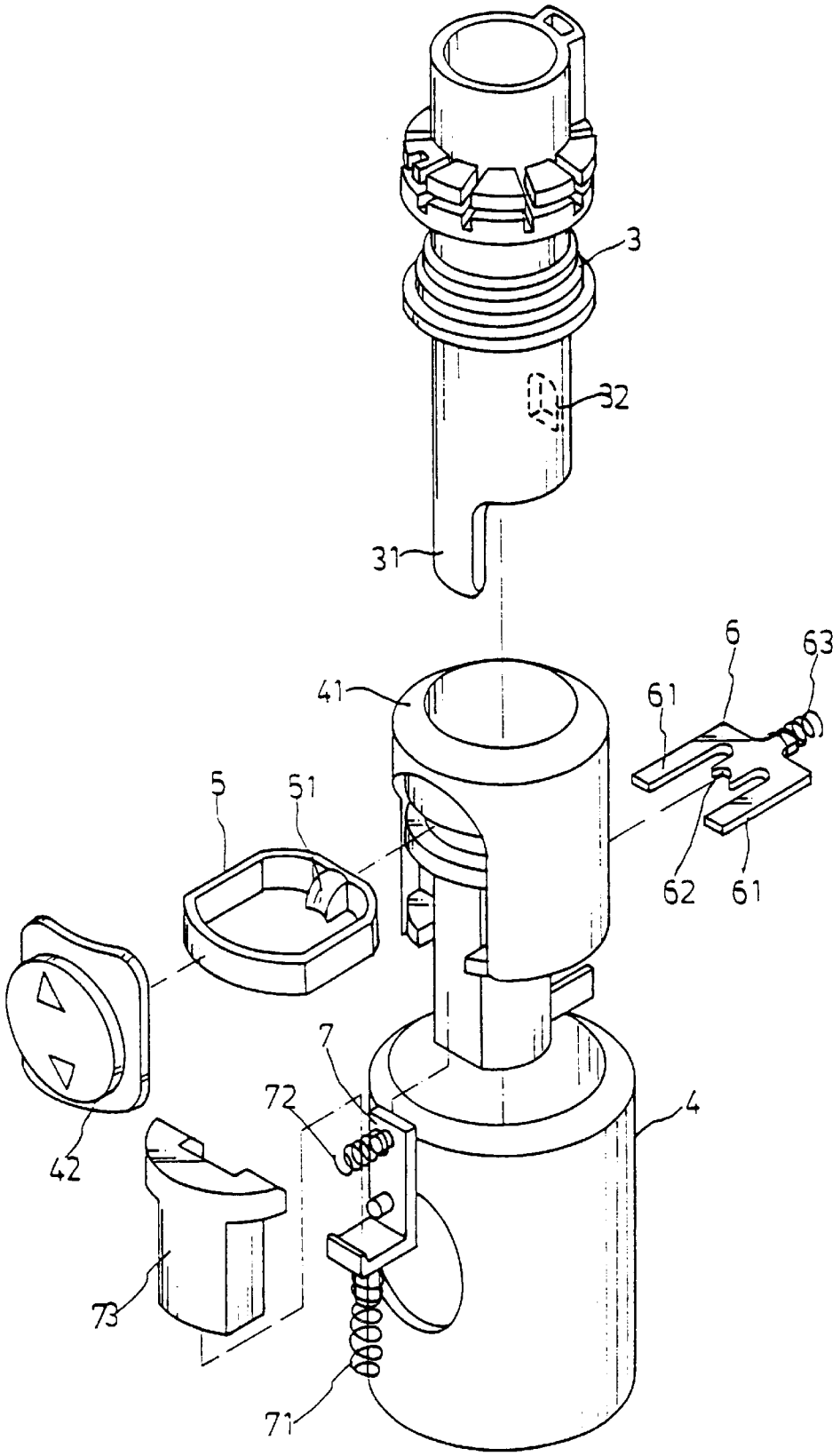
FIG. 1 is a perspective view showing a control apparatus of the umbrella according to the present invention.
Figure 2:
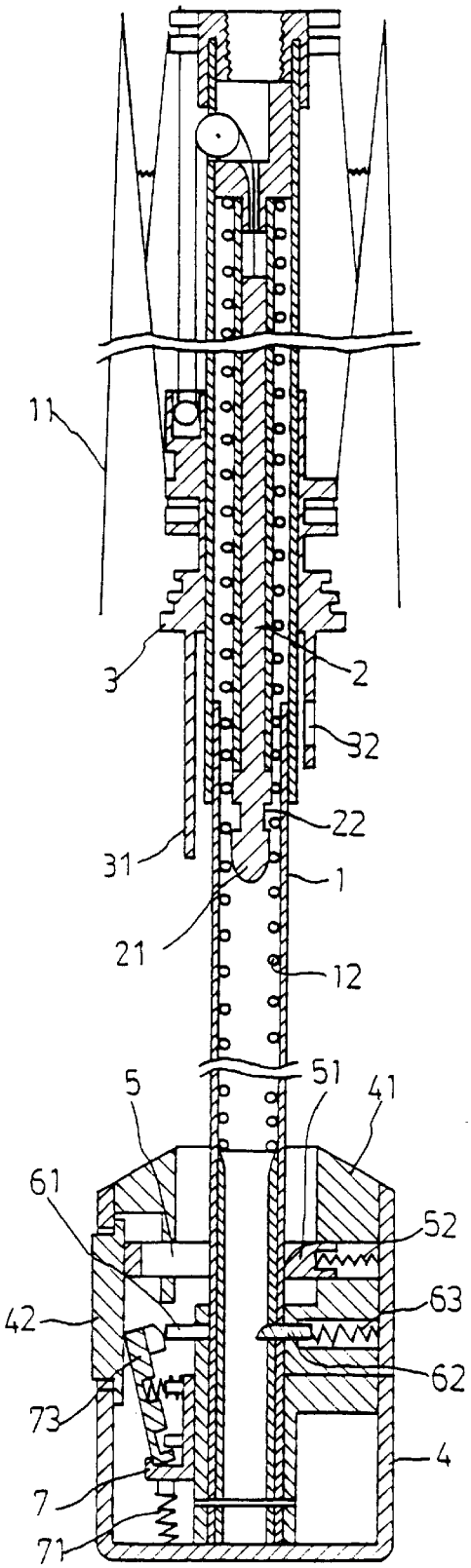
FIG. 2 is a cross sectional view showing the umbrella including the controlling apparatus of the present invention.

Referring to FIGS. 1 and 2, the present invention includes a shaft (1), a frame set (11) with inner springs (12) and a control rod (2) having a lower head (21) with a neck (22), and a runner (3) around the shaft (1) and connected with the frame set (11), that can be used for opening and closing as a known one and will not be described here in detail.

It is a main characteristic of this invention that a controlling apparatus is provided in a handle (4) of the umbrella. The apparatus includes an opening slice (5) and a closing slice (6). A receiver (41 ) is formed in the handle (4) for engaging with a lower end of the shaft (1). The opening slice (5) being ring shape is provided in the receiver (41) and has a tongue (51) extending toward the shaft (1) and a spring (52) provided beside for pushing the slice (5) to contact an inner surface of a button (42) being engaged with the handle (4). The closing slice (6) is provided in the receiver (41) and is parallel to the opening slice (5). The closing slice (6) includes a pair of side pieces (61) extending toward the button (42), a middle tongue (62) being capable of engaging with the shaft (1), and a spring (63) provided on a side to provide an elastic force. An L-shape slice (7) with a lower spring (71) is provided in the handle (4) beside the receiver (41). Another spring (72) is placed on the L-shape slice (7) to connect with a control means (73), bottom of which is hooked in the slice (7) and top of which is capable of contacting with the two pieces (61) of the closing slice (6) one side and contacting with the inner surface of the button (42) the other side.

Figure 3:
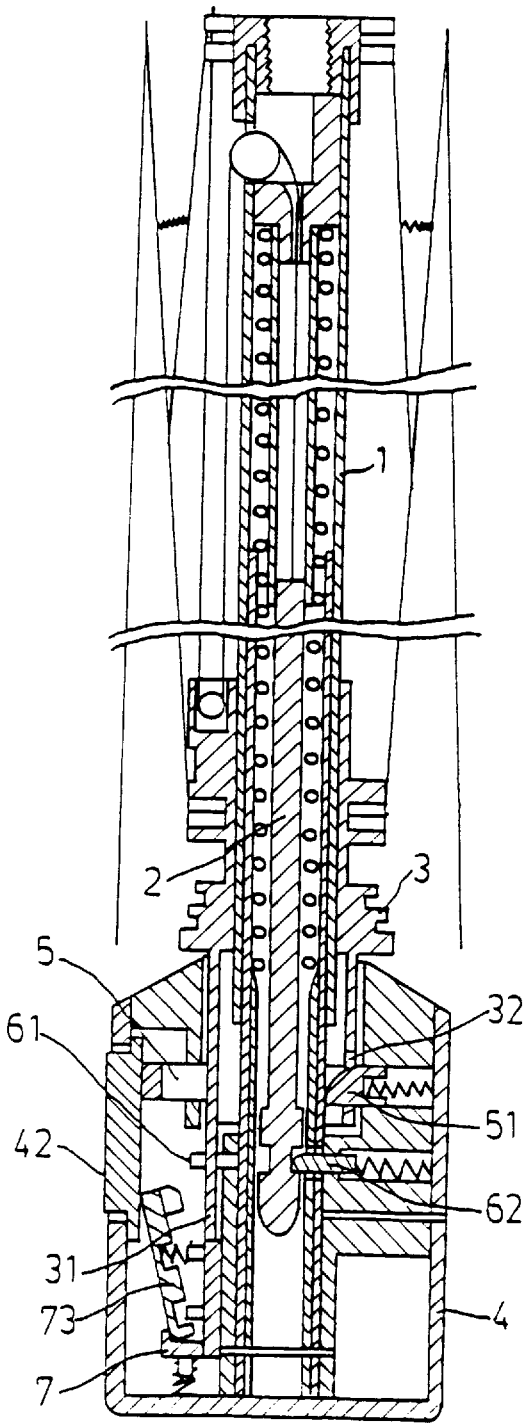
FIG. 3 is a cross sectional view of FIG. 2 showing the umbrella after being compressed.

As a prior known umbrella, it is to be compressed of the shaft (1) before to use. Referring to FIG. 3, a groove (32) formed on the runner (3) is engaged with the tongue (51) of the opening slice (5). At the same time, the control rod (2) is moved downward while the neck (22) on the head (21) is engaged with the tongue (62) of the closing slice (6). Moreover, an extending slice (31) formed on another side of the runner (3) will push the L-shape slice (7) moved downward and left from the closing slice (6).

Figure 4:
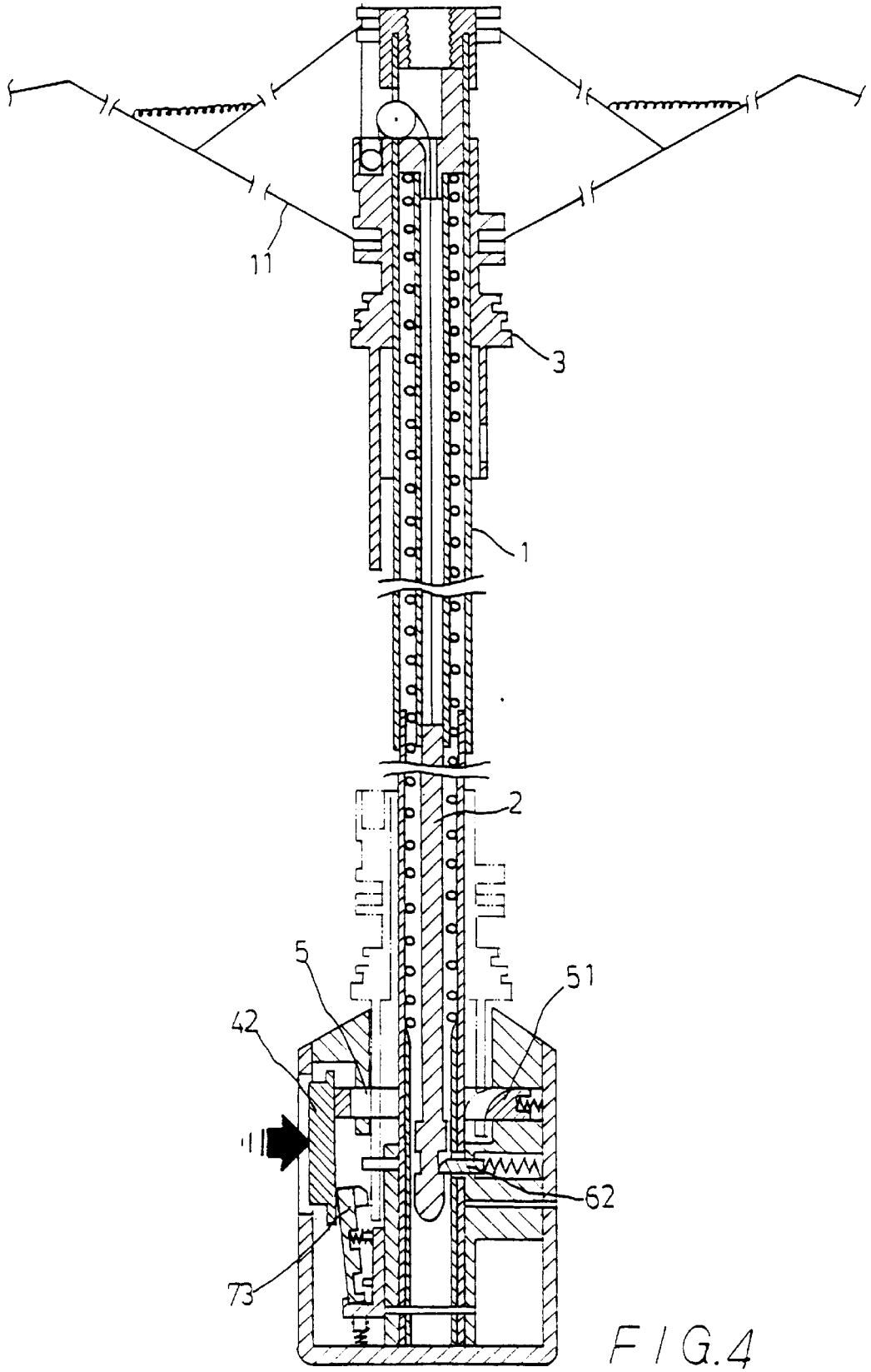
FIG. 4 is a cross sectional view of FIG. 3 showing the umbrella being to be going to be opened.
Figure 5:
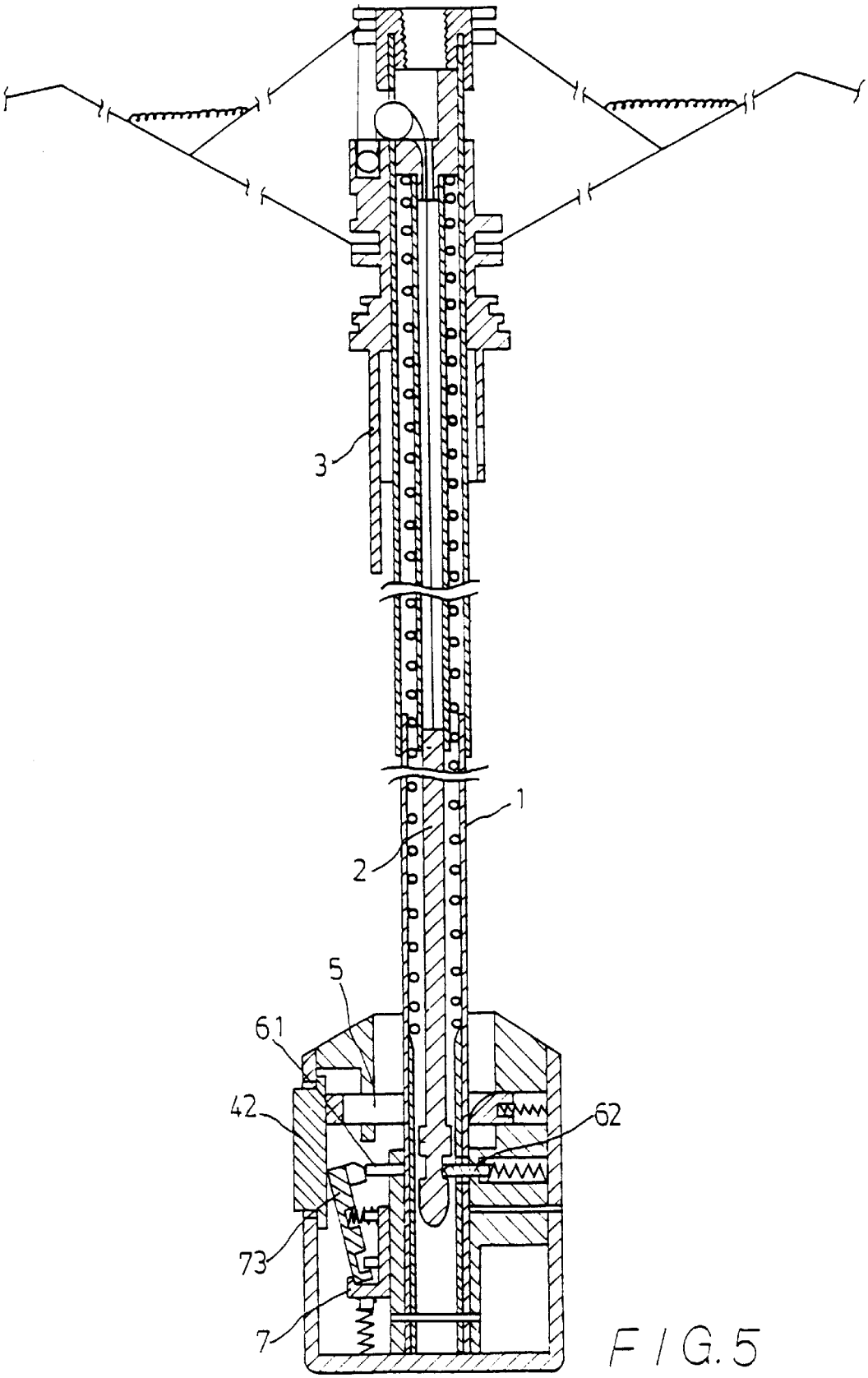
FIG. 5 is a cross sectional view of FIG. 4 showing the umbrella being opened completely.
Figure 6:
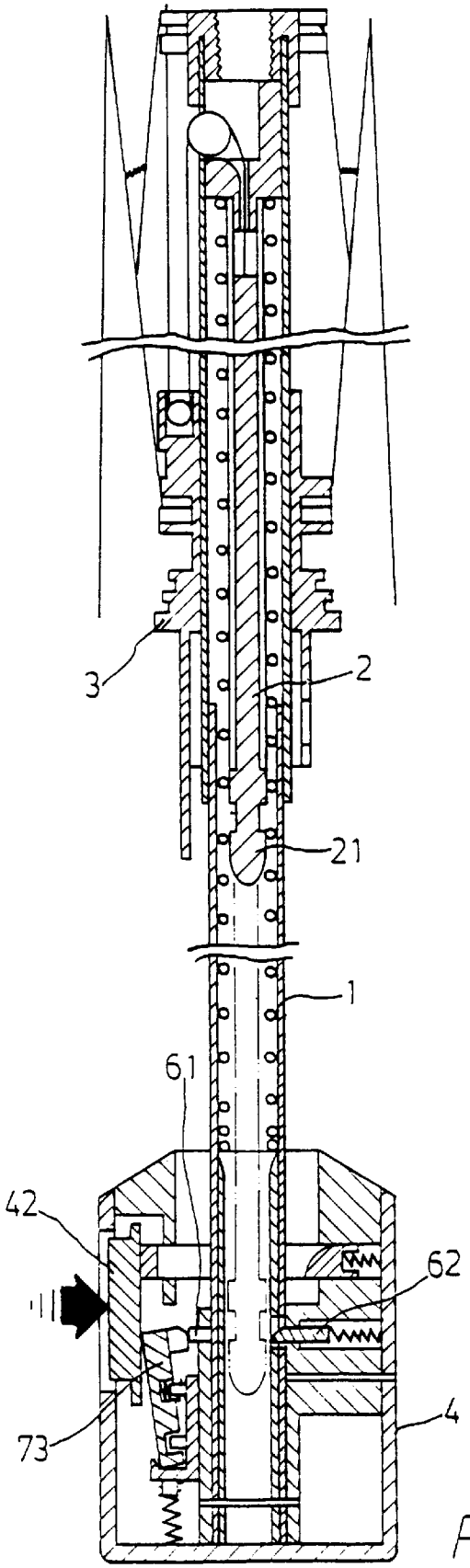
FIG. 6 is a cross-sectional view of FIG. 5 showing the umbrella being closed.

Referring to FIGS. 4 and 5, when to open the umbrella, a user can press the button (42). The opening slice (5) is moved sideward and the tongue (51) left from the groove (32). The runner (3) is then elastically moved upward for opening the umbrella. In this matter, the L-shape slice (7) being moved downward will not be possible to contact with the closing slice (6) and any mistake will not happen. After the umbrella is completely opened, as shown in FIG. 5, the extending slice (31) of the runner (3) has been moved upward. The L-shape slice (7) will be moved upward automatically to an original position between the button (42) and the closing slice (6). If the button (42) is repressed at this time, the control means (73) of the L-shape slice (7) will be moved to push the two pieces (61) of the closing slice (6) moved in the same direction. It will be understood that the tongue (62) of the closing slice (6) will be left from the neck (22) of the control rod (2), which can be moved upward to close the umbrella as in FIG. 2.

In conclusion, the present invention bases on the special controlling apparatus which uses improved slices to open and to close the umbrella and is capable of preventing from a mistaken operation. Thus, this invention should be allowed for patent.

I claim:

1. A controlling apparatus of an umbrella, including an umbrella shaft, a handle having a button, a frame set with inner springs and a control rod having a lower head and a neck, and a runner slidably mounted on the shaft and connected to the frame set, comprising:

an opening slice, a closing slice, and a L-shaped slice are mounted in said handle; a receiver formed in said handle engaging with a lower end of said shaft;

said opening slice being ring shaped and positioned in said receiver; said opening slice having a tongue extending toward said shaft and a first spring on one side for pushing said slice into contact with an inner surface of said button on the handle;

said closing slice being positioned in the receiver parallel to said opening slice; said closing slice includes a pair of side pieces extending toward said button, a middle tongue engaging said shaft, and a second spring on a side to provide an elastic force;

said L-shaped slice having a lower third spring adjacent said receiver, and a fourth spring connecting with a control means, said control means having a bottom portion engaging said L-shaped slice and a top portion placing between the button and the side pieces of said closing slice such that one side of said control means contacting an inner surface of said button, and the opposite side of said control means be able to contact said side pieces of said closing slice.

2. A controlling apparatus of an umbrella as recited in claim 1, wherein as the button being pressed, said opening slice is moved sidewards and said tongue is moved away from a groove in said receiver, and said runner is elastically moved upward for opening the umbrella, said L-shaped slice being moved downwardly out of contact with said closing slice.

3. A controlling apparatus of an umbrella as recited in claim 2, wherein as said button is repressed, said control means is moved to push said side pieces of said closing slice over and the middle tongue of said closing slice is disengaged from the neck of the control rod, whereby said control rod is moved upwardly to close the umbrella.

* * * * *